US007564011B2

(12) United States Patent
Kim et al.

(10) Patent No.: US 7,564,011 B2
(45) Date of Patent: Jul. 21, 2009

(54) MICROWAVE OVEN

(75) Inventors: Gong-soo Kim, Suwon-si (KR); Young-cheol Ko, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 52 days.

(21) Appl. No.: 11/155,586

(22) Filed: Jun. 20, 2005

(65) Prior Publication Data

US 2006/0000827 A1 Jan. 5, 2006

(30) Foreign Application Priority Data

Jun. 19, 2004 (KR) ..... 10-2004-0045835

(51) Int. Cl.
*H05B 6/64* (2006.01)

(52) U.S. Cl. ..... 219/757; 219/678

(58) Field of Classification Search ..... 219/757, 219/756, 758, 678
See application file for complete search history.

(56) References Cited

U.S. PATENT DOCUMENTS

| | | | | |
|---|---|---|---|---|
| 5,459,301 | A * | 10/1995 | Miller et al. | 219/679 |
| 5,632,921 | A * | 5/1997 | Risman et al. | 219/750 |
| 6,247,246 | B1 * | 6/2001 | Scalese et al. | 34/259 |
| 6,624,399 | B2 * | 9/2003 | Rypan | 219/680 |
| 6,911,636 | B2 * | 6/2005 | Shon | 219/757 |
| 2004/0016751 | A1 | 1/2004 | Sung | |

FOREIGN PATENT DOCUMENTS

| | | | |
|---|---|---|---|
| EP | 1 389 895 | B1 | 2/2004 |
| EP | 1 435 684 | A2 | 7/2004 |
| GB | 2 237 487 | A | 5/1991 |
| JP | 60-032790 | U | 3/1985 |
| JP | 2003-172519 | A | 6/2003 |
| KR | 1994-0009816 | Y1 | 6/1992 |
| KR | 1998-0008922 | Y1 | 4/1998 |
| KR | 1998-0015497 | Y1 | 6/1998 |
| KR | 1998-0017792 | Y1 | 7/1998 |
| KR | 1998-0029168 | Y1 | 8/1998 |
| KR | 1998-029624 | U | 8/1998 |
| KR | 2000-0005833 | U | 4/2000 |
| KR | 2002-0007453 | A | 1/2002 |
| KR | 10-2004-0009899 | A | 1/2004 |
| KR | 20-0337662 | Y1 | 12/2004 |
| WO | WO 2005/029922 | A1 | 3/2005 |

* cited by examiner

*Primary Examiner*—Daniel L Robinson
(74) *Attorney, Agent, or Firm*—Sughrue Mion, PLLC

(57) ABSTRACT

A microwave oven has a main body including a cooking compartment, and a component compartment in which a heating component is installed. An outer casing encloses the main body. A fan is provided at the component compartment corresponding to the heating component, and blows outside air to cool the heating component. An air inflow part is formed on the outer casing adjacent to the fan and through which the air from the cooling fan flows. A partitioning wall of a round shape separates the cooking compartment and the component compartment, wherein the fan is inclined with respect to the cooking compartment so that the air flowing through the air inflow part is guided toward the heating component along the partitioning wall.

5 Claims, 3 Drawing Sheets

MICROWAVE OVEN

CROSS-REFERENCE TO RELATED APPLICATIONS

This application claims the benefit of Korean Patent Application No. 2004-0045835, filed Jun. 19, 2004, in the Korean Intellectual Property Office, the disclosure of which is incorporated herein by reference.

BACKGROUND OF THE INVENTION

1. Field of the Invention

The present invention relates to a microwave oven, and more particularly, to a microwave oven comprising an improved flow-path of air to cool a heating component in a component compartment.

2. Description of the Related Art

A microwave oven outputs microwaves to food in a cooking compartment and cooks the food by induction heating.

Generally, the microwave oven comprises the cooking compartment accommodating the food, and a component compartment in which heating components such as a HVT (High Voltage Transformer) transforming supplied voltage to high voltage, and a MGT (Magnetron) outputting the microwaves into the cooking compartment, and etc. are mounted. A cooling fan preventing the heating components such as the HVT, MGT, and etc. from being overheated is mounted inside of the component compartment. Herein, a means for guiding outside air supplied by the cooling fan is required so that the air is easily introduced toward the heating components.

Korean Utility Model Publication No. 0337662 discloses a microwave oven comprising an air guide. The air guide includes an air reflecting part of a rectangle shape having inclines at opposite sides thereof and extended from a lower side of an air guiding part.

With this configuration, the conventional microwave oven prevents efficiency of the microwave oven from being decreased and prevents the MGT and the HVT from being damaged due to overheating.

However, the conventional microwave oven must have the air guide guiding air toward the heating components such as the MGT, the HVT, etc., thereby increasing manufacturing cost for producing and assembling the air guide.

SUMMARY OF THE INVENTION

Illustrative, non-limiting embodiments of the present invention overcome the above disadvantages and other disadvantages not described above.

Accordingly, an apparatus consistent with the present invention provides a microwave oven cooling a heating component in a component compartment without a separate air guide guiding air to the heating component.

Additional aspects and/or advantages of the invention will be set forth in part in the description which follows and, in part, will be obvious from the description, or may be learned by practice of the invention.

The foregoing and/or other aspects of the present invention are achieved by providing a microwave oven comprising a main body including a cooking compartment, and a component compartment in which a heating component is installed; an outer casing enclosing the main body; a fan provided at the component compartment corresponding to the heating component, and blowing outside air to cool the heating component; an air inflow part formed on the outer casing adjacent to the fan and through which the air from the cooling fan flows; and a partitioning wall of a round shape and separating the cooking compartment and the component compartment, wherein the fan is inclined with respect to the cooking compartment so that the air flowing through the air inflow part is guided toward the heating component along the partitioning wall.

According to the present invention, wherein the partitioning wall is formed with an air supplying hole through which the air passing through the heating component is supplied to the cooking compartment after flowing along the partitioning wall, and an air discharging hole discharges the air which passed the cooking compartment.

According to the present invention, the cooking compartment and the component compartment are separated from each other by the partitioning wall in front and rear sides thereof, and the fan and the heating component are separated from each other in left and right sides thereof in the component compartment.

BRIEF DESCRIPTION OF THE DRAWINGS

The features and advantages of the invention will become apparent and more readily appreciated by describing in detail exemplary embodiments thereof, taken in conjunction with the accompanying drawings of which.

DETAILED DESCRIPTION OF THE ILLUSTRATIVE, NON-LIMITING EMBODIMENT

Figure 1:
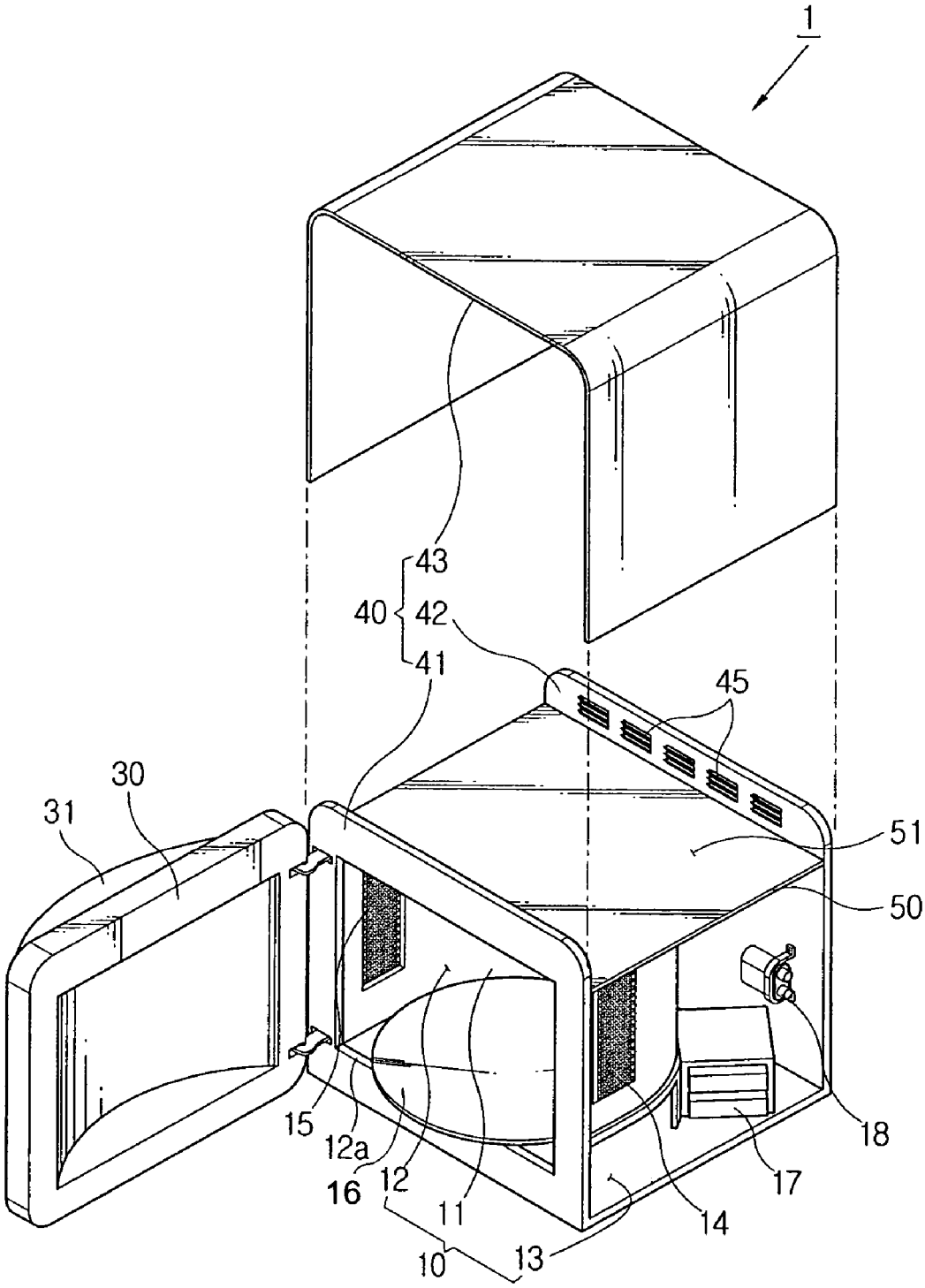
FIG. 1 is a front exploded perspective view of a microwave oven according to the present invention.

Reference will now be made in detail to the embodiments of the present invention, examples of which are illustrated in the accompanying drawings, wherein like reference numerals refer to like elements throughout.

Figure 2:
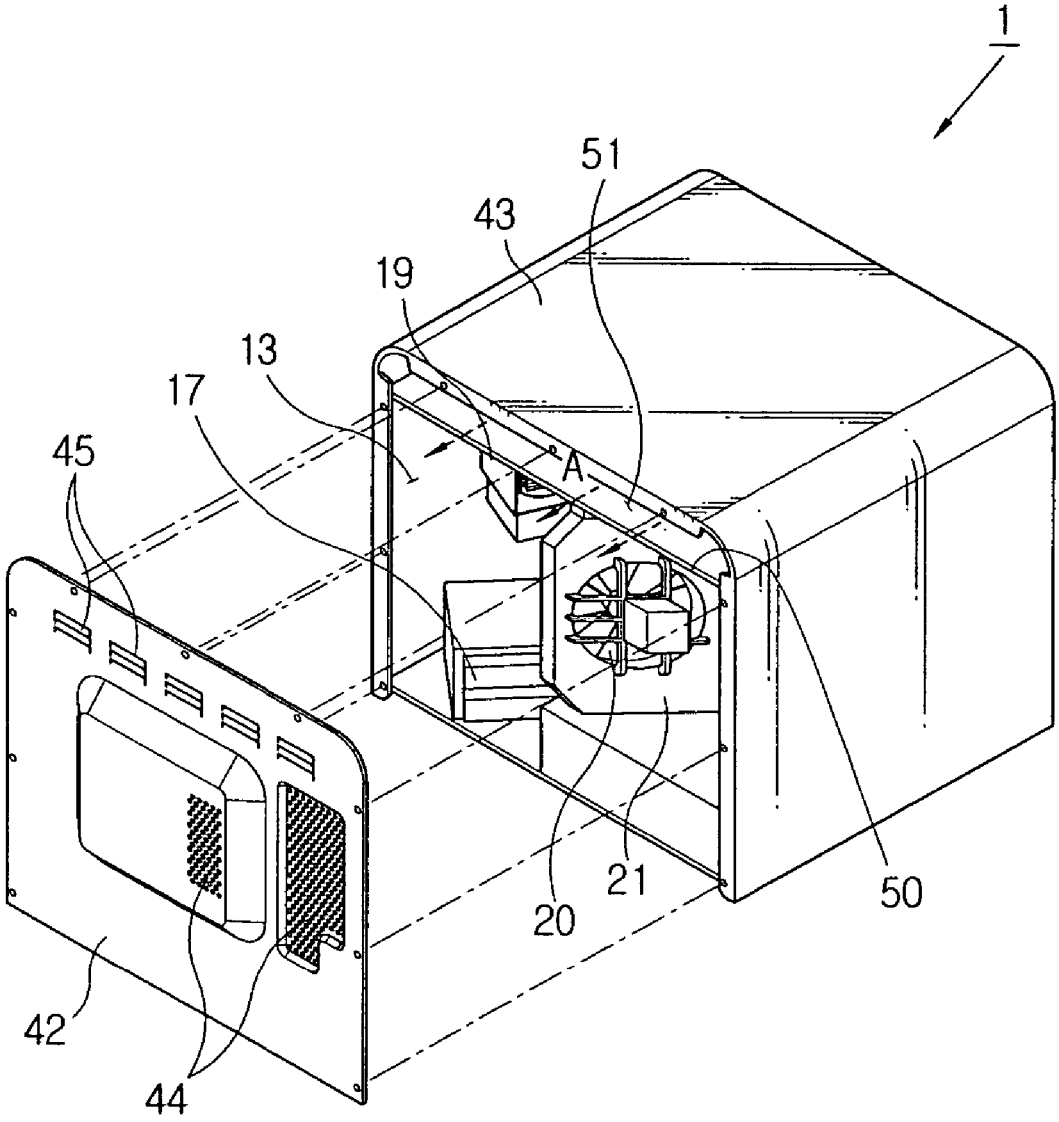
FIG. 2 is a rear exploded perspective view of a microwave oven according to the present invention.

As shown in FIGS. 1 and 2, a microwave oven 1 according to the present invention comprises a main body 10 formed with a cooking compartment 12 and a component compartment 13 which are partitioned from each other by a partitioning wall 11; a door 30 mounted in front of the cooking compartment 12, opening and closing a front opening 12*a*, and including an operating panel 31; and an outer casing 40 installed outside the main body 10 and forming an outer appearance of the main body 10.

The outer casing 40 comprises a front casing 41 enclosing a front side of the main body 10; a rear casing 42 enclosing a rear side of the main body 10; and a side-upper casing 43 enclosing the main body 10 in cooperation with the front casing 41 and the rear casing 42, and shaped like an inverted "U". A mounting bracket 50 of a plate shape mounted with kinds of components is provided between an upper part of the main body 10 and the side-upper casing 43.

In the cooking compartment 12 is provided a tray 16 to accommodate food. Air supplying holes 14 are formed on the partitioning wall 11 between the cooking compartment 12 and the component compartment 13, so that outside air A flows into the cooking compartment 12. Also, in the partitioning wall 11 are formed air discharging holes 15 corresponding to the air supplying holes 14 so as to discharge the air A supplied through the air supplying holes 14 with humidity in the cooking compartment 12 to the outside of the cooking compartment 12. The partitioning wall 11 partitions the cooking compartment 12 and the component compartment 13 in front and back sides thereof respectively, and is formed like a round shape so that the cooking compartment 12 is of a round shape. Accordingly, the air A from a fan 20 flows along a round shaped partitioning wall 11.

In the component compartment 13 are provided heating components such as a HVT 17 transforming supplied voltage to high-voltage; a HVC (High Voltage Capacitor) 18 charging the high-voltage from the HVT 17; and a MGT 19 supplying microwaves into the cooking compartment 12 after generating the microwaves using the charged high-voltage of the HVC 18. The heating components 17, 18, and 19 are provided at a right rear side of the cooking compartment 12. The fan 20 cooling the heating components 17, 18, and 19 by blowing the air A is installed at a left rear side of the cooking compartment 12. An air inflow part 44 is formed at the rear casing 42 to flow the air A to the component compartment 13 by rotating of the fan 20.

The air inflow part 44 is preferred but not necessary to be plural and be in a position to easily flow the air A into the component compartment 13 by the fan 20. Herein, the air inflow part 44 is provided at the rear casing 42 but it is possible that the air inflow part 44 is provided adjacent to the fan 20 at a left side of the side-upper casing 43.

Figure 3:
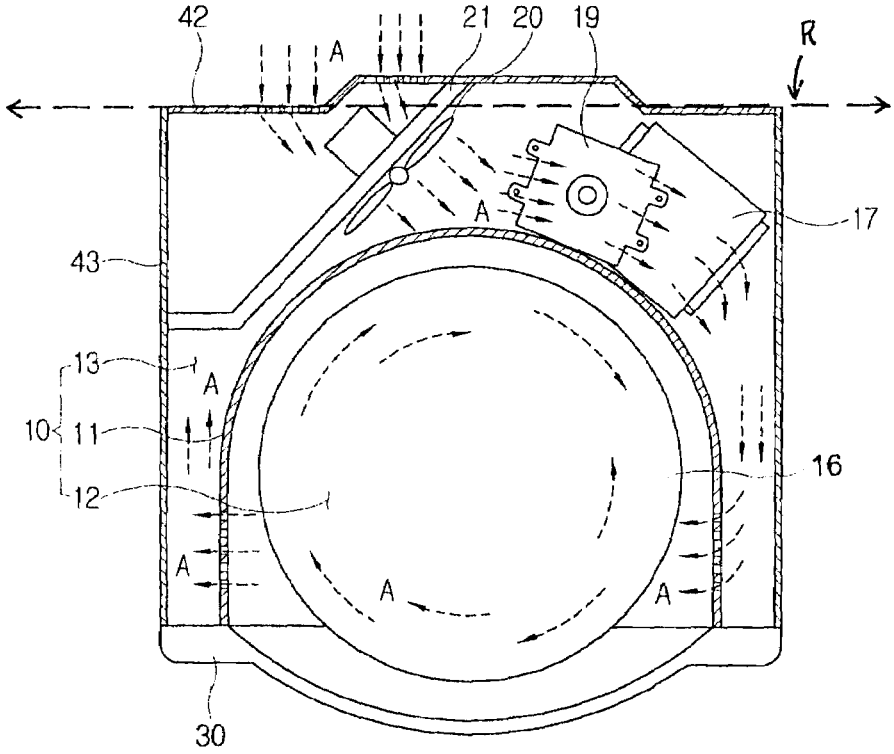
FIG. 3 is a plane sectional view illustrating a flow-path of air at a microwave oven according to the present invention.

As shown in FIG. 3, the fan 20 is mounted on a fan supporter 21. The fan supporter 21 and the fan 20 are inclined with respect to the cooking compartment 12. More specifically, as shown in FIG. 3, a rotation axis of the fan 20 is inclined with respect to a rear plane R of the main body. Accordingly, the air A flowing through the air inflow part 44 flows toward the heating components 17 and 19 in the component compartment 13 along the round shaped partitioning wall 11 by rotation of the fan 20, and then the air A cools the heating components 17 and 19. Accordingly, the conventional air guide guiding the air A toward the heating components 17 and 19 is not necessary. The air A which passed through the heating components 17 and 19, flows along the partitioning wall 11 again, and flows into the cooking compartment 12 through the air supplying holes 14 formed on a right side of the partitioning wall 11. Accordingly, a separate guide is not necessary because the air A which passed through the heating components 17 and 19 easily flows to the air supplying holes 14 after flowing along the round shaped partitioning wall 11. After the air A in the cooking compartment 12 circulates inside of the cooking compartment 12, the air A is discharged to an outside of the cooking compartment 12 through the air discharging holes 15 formed on the left side of the partitioning wall 11. Accordingly, the humidity inside of the cooking compartment 12 is eliminated therefrom. The air A discharged through the air discharging holes 15 on the partitioning wall 11 may be discharged to an outside of the microwave oven 1 through an air exhaust part 45 formed on the rear casing 42 after being guided toward an upper space 51 of the mounting bracket 50 (see FIG. 2). Accordingly, the air A of high temperature and humidity in the cooking compartment 12 is easily discharged so that an inside of the door 30 is prevented from being humid.

As described above, because the fan 20 is inclined with respect to the cooking compartment 12, wherein the rotation axis of the fan 20 is inclined with respect a rear plane R of the main body of the oven, and accordingly the air A flowing through the air inflow part 44 is guided toward the heating components 17 and 19 along the round shaped partitioning wall 11, the heating components 17 and 19 in the component compartment 13 can be sufficiently cooled without a separate guide. Also, the air A which passed through the heating components 17 and 19, also flows along the partitioning wall 11 and flows into the cooking compartment 12 through the air supplying holes 14, thereby eliminating the humidity in the cooking compartment 12.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A microwave oven comprising:

a main body including a cooking compartment, and a component compartment in which a heating component is installed;

an outer casing enclosing the main body;

a fan provided in the component compartment corresponding to the heating component, and blowing outside air to cool the heating component;

an air inflow part formed on the outer casing adjacent to the , wherein air flows through the air inflow part toward the heating component by rotation of the fan; and a partitioning wall separating the cooking compartment and the component compartment, the partitioning wall comprising a round shaped portion, a rotation axis of the fan being inclined with respect to a rear plane of the main body so that the air flowing through the air inflow part is guided toward the heating component along the round shaped portion of the partitioning wall.

2. The microwave oven according to claim 1, wherein the partitioning wall is formed with an air supplying hole through which the air passing through the heating component is supplied to the cooking compartment after flowing along the partitioning wall, and an air discharging hole discharging the air which passed the cooking compartment.

3. The microwave oven according to claim 1, wherein the cooking compartment and the component compartment are separated from each other by the partitioning wall in front and rear sides thereof, and the fan and the heating component are separated from each other in left and right sides thereof in the component compartment.

4. The microwave oven according to claim 2, wherein the cooking compartment and the component compartment are separated from each other by the partitioning wall in front and rear sides thereof, and the fan and the heating component are separated from each other in left and right sides thereof in the component compartment.

5. The microwave oven according to claim 1, wherein the inclined position of the fan and the partitioning wall facilitate the air in the component compartment to flow through the component compartment in a clockwise direction, along the partitioning wall.

* * * * *